United States Patent [19]

Polonsky

[11] 4,208,867

[45] Jun. 24, 1980

[54] TIMING DEVICE

[75] Inventor: Samuel Polonsky, Monroe, Conn.

[73] Assignee: Timex Corporation, Waterbury, Conn.

[21] Appl. No.: 934,356

[22] Filed: Aug. 17, 1978

[51] Int. Cl.[2] ..... G04B 23/02

[52] U.S. Cl. ..... 368/262

[58] Field of Search ..... 58/21.15, 21.155, 38 R, 58/38 A, 16 R, 19 R, 21.1; 340/393, 394

[56] References Cited

U.S. PATENT DOCUMENTS

| | | | |
|---|---|---|---|
| 2,768,332 | 10/1956 | Protzmann et al. | 58/21.15 |
| 2,920,438 | 1/1960 | Phaneuf | 58/21.12 |
| 3,559,396 | 2/1971 | Wingler | 58/21.12 |

*Primary Examiner*—Edith S. Jackmon

*Attorney, Agent, or Firm*—William C. Crutcher

[57] ABSTRACT

In an alarm clock with an alarm vibrator arm and a reciprocating vibrator shut-off lever having an alarm "on" position out of engagement with the vibrator arm and an "off" position in engagement with the arm, an improvement is provided in the shut-off lever which consists of making the lever in an integral molded plastic flat plane with a pair of co-planar upper and lower cantilever arms extending from a bight to form the free end, the arms being disposed adjacent and coextensive with each other. The arms are resiliently deformable toward each other in the plane and are disposed in the slot to be guided along the upper and lower edges respectively. The arms are inwardly tapered on their outer surfaces from the free end towards the bight and a bevel section is provided on the upper arm at the end thereof. The pivot pin extends below the upper edge of the slot to form a cooperating detent with the bevel when the lever is in the "on" position. Plural stops are disposed along the lower lever edge limiting reciprocation in the "on" and "off" positions.

5 Claims, 6 Drawing Figures

Fig. 1.
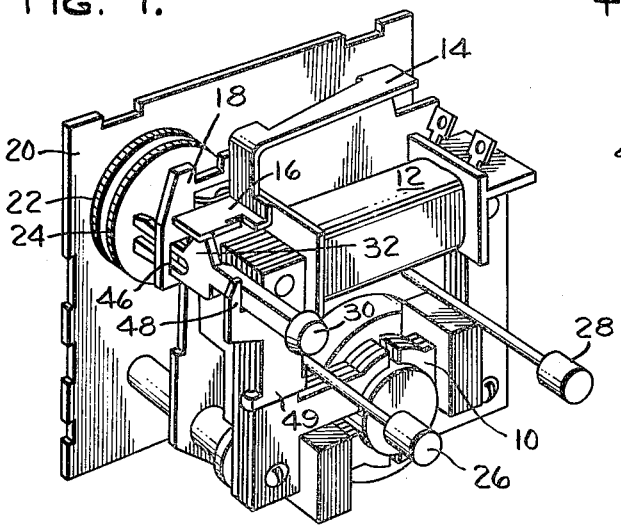
Fig. 2.
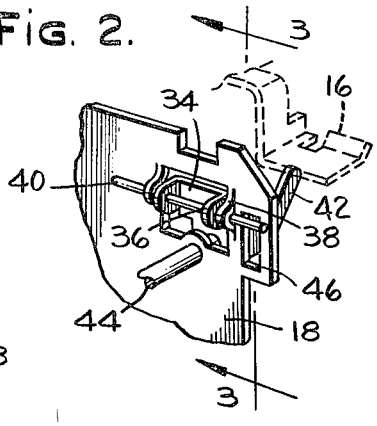
Fig. 5.
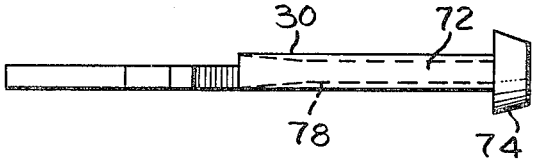
Fig. 6.
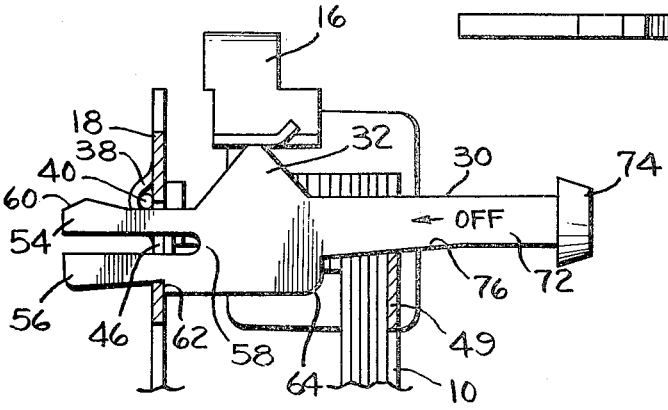
Fig. 3.
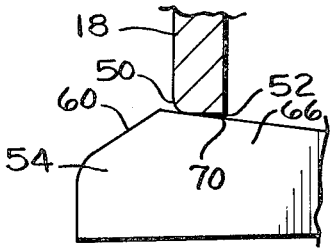
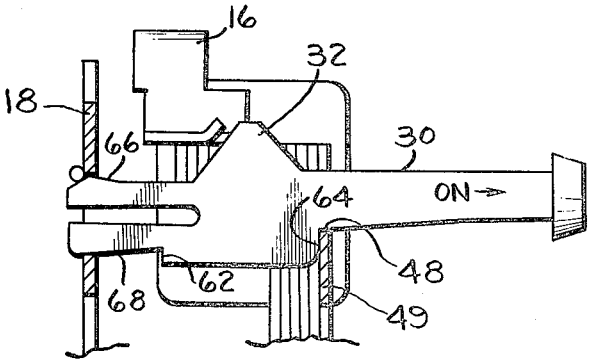
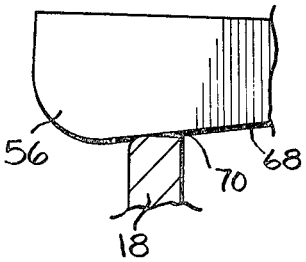
Fig. 4.

TIMING DEVICE

BACKGROUND OF THE INVENTION

1. Field of the Invention

The invention herein pertains to a timing device such as an alarm clock with an alarm vibratory arm and reciprocating vibrator shut-off lever using standard well known timing structure. An improved shut-off lever construction is provided that is more cost effective, provides for cosmetic variations, and has improved and safer operation.

2. Description of the Prior Art

In the prior art of alarm clocks, it is well known to provide various timing devices to set and control the alarm through a push/pull lever wherein the alarm is set by pulling the lever out the back of the clock casing and, when the alarm sounds, pushing the lever in to silence the alarm. Such a standard structure is shown in U.S. Pat. No. 2,768,332 and various improvements have been provided from time to time such as the provision of interval mechanisms that allow the sleeper to push a bar and actuate the mechanism when the alarm sounds so that he may return to sleep for a short period of time without fear of oversleeping, since the alarm will sound again after a short time interval. Such a structure is shown in U.S. Pat. No. 2,920,438. Another improvement is a structure for adjusting the loudness of the alarm through a suitable mechanism such as a slider so that the alarm may be made loud or soft or in between by simply sliding an actuating lever back and forth as shown in U.S. Pat. No. 3,559,396 all patents being of common assignment. Also with the advent of modern and moldable plastics, much of the old metallic structure in clocks has been replaced by plastic pieces. However, the standard shut-off lever such as that shown in said U.S. Pat. No. 2,768,332 patent has been retained in the type of structure shown because of its simplicity and standardization of many parts over many years. The present invention is an improvement on said U.S. Pat. No. 2,768,332 patent in replacing the old metallic shut-off lever in the patent with an improved integral molded and particularly formed plastic lever to provide a less expensive construction, much improved operation in both smoothness of sliding and safety by being electrically neutral and providing opportunity for many cosmetic variations in color changes and the like.

SUMMARY OF THE INVENTION

Briefly described, the invention is directed to the combination of an alarm clock having an alarm vibrator arm and a conventional reciprocating vibratory shut-off lever for an alarm "on" position out of engagement with the vibrator arm and an "off" position in engagement with the arm. Gear means is continuously rotated as a function of time and cooperates with first and second coaxially spaced and movable cam members rotatably adjustable relative to each other to set the alarm with the vibrator arm being disposed to exert a biasing force towards the second cam to engage it with the first, the biasing being through a pivoted bell crank located between the arm and second cam. The crank moves on a pivot pin mount on a base plate which plate has an enclosed slot for guiding a free end of the shut-off lever. To this standard combination structure an improvement is provided in the shut-off lever by making it into an integral molded plastic planar member with a pair of co-planar upper and lower cantilever arms extending from a bight to form the lever free end, the arms being disposed adjacent and coextensive with each other. The arms are resiliently deformable towards each other in the plane and are disposed in the base plate slot for guidance along the upper and lower edges respectively. Preferably, the arms are inwardly tapered on their outer surfaces from their free end towards the bight and a bevel section is provided on the upper arm at the free end thereof. The pivot pin is disposed to extend below the upper edge of the slot forming a cooperating detent with the arm bevel when the lever is in "on" position. The other end of the lever contains a shaft portion that is also preferably tapered in two planes for smooth operation and stop means are provided along the lower lever edge to limit reciprocation at both the "on" and "off" position. This particularly formed integral shut-off lever is smooth operating, usable with the structure already present, has long life, is electrically safe, and simplified over prior constructions. Thus, the main object of the invention is to disclose a particularly formed push/pull alarm shut-off lever in an otherwise known combination for improved overall operation.

BRIEF DESCRIPTION OF THE DRAWING

FIG. 1 is a perspective view of the general clock timing mechanism showing the lever in "off" position.

FIG. 2 is a detailed partial perspective of the pivot pin arrangement.

FIG. 3 is a partial section taken in the direction of line 3—3 of FIG. 2 with the lever in the "off" position.

FIG. 4 is a view similar to FIG. 3 with the lever in the "on" position.

FIG. 5 is a top view of the lever showing the preferred taper dotted and,

FIG. 6 is an enlarged partial section of the rounded and beveled free end of the lever through the punched base plate.

DESCRIPTION OF THE PREFERRED EMBODIMENT

The invention herein uses generally known timing mechanism and, for reference purposes, is an improvement on the general structure shown in said U.S. Pat. No. 2,768,332 with a new and particularly formed plastic shut-off lever structure that is designed to replace shut-off lever 11 in said patent. Referring first to FIG. 1, there is shown the general known timing mechanism of an electrically driven alarm clock, the timing mechanism being driven by a self-starting synchronous motor having a stator magnet core 10 and energizing coil 12. A resilient magnetic vibrator arm 14 is operated by leakage flux from the motor to vibrate at twice the 60 cycle AC with its free end bracket portion 16 vibrating against the stator and producing an audible alarm at all times when the motor is energized unless the arm 14 is prevented from vibrating.

A supporting structure includes base plate 18 and a front plate 20 spaced from plate 18 and parallel thereto for supporting the clock timing mechanism. For operating the alarm, a first cam gear member 22 has a projecting cam portion not shown located on its back face and cam 22 is continuously rotated as a function of time by the motor both in a conventional manner not shown. Coaxially spaced on the same shaft from first cam 22 is a second cam gear member 24 and this contains a cooperating slot in its surface not shown to mesh with the cooperating projecting cam portion on the back surface of cam 22 so that cam 24 moves axially left in FIG. 1 when the preset time brings the parts together thereby permitting vibrator arm 14 to sound the alarm. For setting the alarm, the two cams are rotatably adjustable relative to each other with cam 22 being set to the desired alarm time through alarm shaft 26 and the correct time being set by an adjacent shaft 28.

The resilient vibrator arm 14 is used to provide a biasing force to load the movable second cam 24 into engagement with first cam 22 through a suitable lever mechanism such as bell crank 34 which is pivoted to base plate 18 by means of ears 36, 38, rotation being provided by a pivot pin 40. Thus, bell crank 34 transmits a biasing force created by the spring force of vibrator arm 14 resting on an extension 42 of the bell crank to push against the end of shaft 44 on which the cam members 22 and 24 are mounted. Accordingly, when the timing mechanism of the clock drives cam 22 to a position where the projecting cam surface on its rear face is aligned with the corresponding slot formed in the surface of cam 24, the vibrator 14 acting through its free end portion 16 on extension 42 of bell crank 34 rapidly forces cam 24 left in FIG. 1 to free the vibrator arm 14 so that it vibrates under the influence of the electromagnetic force to give an audible and continuous signal. If the shut-off lever 30 is moved to the left or "off" position of FIG. 3, projection 32 engages the free end 16 of the vibrator arm 14 lifting it out of engagement with the bell crank lever extension 42 to restrain further vibratory movement of the vibrator arm 14 and also removing the biasing force from the end of shaft 44.

The structure thus far described is fully illustrated and described in greater detail in the said U.S. Pat. Nos. 2,768,332 and 2,920,438.

In accordance with the present invention, the shut-off lever 30 is improved over that in the prior art as shown in said patents and it is to this particularly formed improved shut-off lever structure in combination with the well-known clock timing structure that the present invention provides an improved overall combination with advantages as will become apparent.

The prior art used a relatively expensive metallic shut-off lever that provided bias forces in several directions, that used additional structure to perform separate functions, and used structure upon which the present invention greatly simplifies. To this end, shut-off lever 30 is mounted for reciprocating movement of one end, called the free end, in an enclosed slot 46 formed in base plate 18 and at the other end it is supported for movement in corresponding open slot 48 both of which are formed in a punch-press operation that tends to leave rounded corners 50 and sharp edges 52 on the front and rear surfaces respectively depending on the direction which the plate is punched as seen in FIG. 6. Thus, movement of the conventional metallic shut-off lever along the surfaces is somewhat frictionally restricted and not completely smooth. To improve this, the present shut-off lever 30 in accordance with the invention is formed of a single integral molded plastic single plane or planar member as shown in FIG. 5 and it is formed to have a pair of common planar upper and lower cantilever arms 54 and 56 respectively that extend substantially from a bight portion 58 to form the free end of the shut-off lever with the arms being disposed adjacent and coextensive with each other as shown in FIGS. 3 and 4. Being plastic, the arms are readily more resiliently deformable toward each other in the plane of the arms and they are disposed in the slot 46 for guidance along the upper and lower edges respectively with guidance on the upper surface being primarily by the pivot pin 40 as further explained. In order to provide a detent feel, a bevel section 60 is provided on the upper arm 54 at its extreme free end. Cooperating with the bevel section, pivot pin 40 is made to extend below the upper edge of slot 46 to cooperate with the bevel section in the lever "on" position, as shown in FIG. 4. This arrangement permits the pin 40 to serve both for pivoting the bell crank as well as forming a detent with lever 30 as opposed to a simple pivot as in the prior art construction. Thus, the pivot pin serves a dual purpose. To limit reciprocation of lever 30 in both directions, a suitable stop means 62 and 64 are formed in the lever and disposed along the lower edge to cooperate with base plate 18 and the bottom of slot 48 in the positions of FIG. 3 and FIG. 4.

Providing for the flexibility necessary and for better sliding through the metallic supporting plates, cantilever arms 54 and 56 are preferably inwardly tapered on their outer surfaces at 66 on the top arm and 68 on the lower arm respectively as seen in FIG. 6. This insures a relief angle 70 of about five degrees between the arms and supporting plate 18 to minimize wear and provide for lower friction which is enhanced by making the lever 30 of plastic. This provides a very smooth operating shut-off lever that easily slides with substantially no wear whatever with the tapered surfaces cooperating very well with the base plate 18 edges of slot 46.

In order to actuate the shut-off lever 30, the other end is provided with a shaft portion 72 extending away from the bight 58 in the direction opposite the arms and this may have an actuation button 74 at its end. The shaft portion of lever 30 is supported in the open slot 48 formed in support bracket 49 and again, the shaft portion may be provided with a similar taper 76 extending away from the bight 58 towards button 74 to narrow the shaft with the taper being formed on the lower edge for similar cooperation and a relief angle support with bracket 49. Further relief may be provided with the sides of slot 48 by tapering the shaft inwardly toward the button in its planar surfaces shown by dotted lines 78.

All of the tapers, stops, and cantilever arms with the bevel portion may be formed from a single inexpensive molding so that the parts may be rapidly manufactured in any shape or color desired. They are much less expensive than the more complicated old metallic arms and lend themselves to various cosmetic variations since suitable colors may be employed to match the clock housings. Finally, with suitable plastics such as an acetal, the arm is substantially impervious to wear when it uses the tapered and relief angle construction disclosed herein and the single or co-planar cantilever arm flexible construction tends to squeeze the arms into slot 46 and allows for easy assembly by merely dropping a shut-off lever 30 in position from the upper right as shown in FIG. 4. Thus, the assembly line operation is simplified and, while not a great danger, there is no possibility of any electrical transmission through the integral plastic lever 30 as opposed to the old metallic shut-off levers or multiple part metal/plastic levers.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an alarm clock having an alarm vibrator arm and a reciprocating vibrator shut-off lever with an alarm "on" position out of engagement with said arm and an "off" position in engagement with said arm, gear means continuously rotated as a function of time cooperating with first and second coaxially spaced and movable cam members which are rotatably adjustable relative to each other to set the alarm, and said vibrator arm exerting a biasing force urging the second cam into engagement with the first through a pivoted bell crank between the arm and second cam, the crank having a pivot pin mount on a base plate with an enclosed slot with an upper edge for guiding a free end of said shut-off lever, an improvement in said lever comprising, an integral molded plastic planar member having upper and lower edges and having a pair of co-planar upper and lower cantilever arms having outer surfaces and extending from a bight to form said free end and disposed adjacent and coextensive with each other, said arms being resiliently deformable toward each other in said plane and disposed in said slot for guidance along said outer surfaces, a bevel section on the upper arm at the end thereof, said pivot pin extending below said slot upper edge to form a cooperating detent with said bevel in lever "on" position, and stop means disposed along the lower planar member edge limiting reciprocation at the "on" and "off" positions.

2. Apparatus as described in claim 1 wherein said arms are each inwardly tapered on their outer surfaces from the free end towards said bight providing a relief angle between said arms and guide slot.

3. Apparatus as described in claim 2 wherein said lever has a shaft portion extending away from said bight opposite said arms with an actuation button at the end of said shaft.

4. Apparatus as described in claim 3 wherein a support bracket is disposed spaced from said base plate to support a lower edge defined on said shaft portion for said reciprocal movement, said shaft portion being tapered away from said bight towards said button, along said shaft portion, supported lower edge.

5. Apparatus as described in claim 4 wherein said shaft portion is also tapered inwardly towards said button in its planar direction.

* * * * *